US006378673B2

(12) United States Patent
Libby

(10) Patent No.: US 6,378,673 B2
(45) Date of Patent: Apr. 30, 2002

(54) REMOVABLE TRAVEL CASE CASTER SYSTEM

(75) Inventor: Kenneth J. Libby, Macomb County, MI (US)

(73) Assignee: The United State of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 09/822,297

(22) Filed: Mar. 30, 2001

Related U.S. Application Data

(60) Provisional application No. 60/191,699, filed on Mar. 23, 2000, and provisional application No. 60/191,694, filed on Mar. 23, 2000.

(51) Int. Cl.[7] ..... A45C 5/14

(52) U.S. Cl. ..... 190/18 A; 190/18 R; 190/115; 280/37

(58) Field of Search ..... 190/18 A, 18 R, 190/115; 280/37; 16/45, 18 R

(56) References Cited

U.S. PATENT DOCUMENTS

| | | | | | |
|---|---|---|---|---|---|
| 4,062,429 | A | * | 12/1977 | Tabor et al. | 190/18 A |
| 4,618,035 | A | * | 10/1986 | Mao | 190/18 A |
| 5,379,870 | A | * | 1/1995 | Sasow | 190/18 A X |
| 5,423,561 | A | * | 6/1995 | Sadow | 190/18 A X |
| 5,524,920 | A | * | 6/1996 | Tsai | 190/18 A X |
| 5,758,751 | A | * | 6/1998 | Charles | 190/18 A X |

* cited by examiner

*Primary Examiner*—Lee Young
*Assistant Examiner*—Tri M. Mai
(74) *Attorney, Agent, or Firm*—David L. Kuhn; Clifford C. Carter; Gail S. Soderling

(57) ABSTRACT

A wheeled caster assembly engages a carrying case at the handle thereof, but the assembly is easily removed from the case. The caster assembly has a base on which the case rests. The base is supported by a wheeled caster at one end and a strut at the other end. A keel on the underside of the base is disposed between the caster and the strut. The keel contacts the crossbar of the handle such that the upper side of the base faces against the case. A corner of the case fits with a complementary corner formed by the base and an upright flange at the one end of the base.

2 Claims, 2 Drawing Sheets

REMOVABLE TRAVEL CASE CASTER SYSTEM

This application claims benefit of Provisional applications Ser. No. 60/191,699 filed on Mar. 23, 2000 and Ser. No. 60/191,694 filed Mar. 23, 2000.

GOVERNMENT USE

The invention described here may be made, used and licensed by the or for the U.S. Government for governmental purposes without paying me any royalty.

BACKGROUND

Exhibitors at trade shows typically have displays that can be disassembled and stored in specially designed box-like carrying cases for convenient shipping. Often the cases' handles swing out for easy access by workers moving the containers and the handles swing back to make the cases more compact for shipping and storage. A problem arises if relatively large, heavy cases need to be moved from one point to another at an exhibition site where hand trucks or dollies are not available. In these instances, workers are forced into carrying the cases, which is tiring and has some risk of injury. For this reason, some conventional cases have wheels attached, but the wheels are not easily removed for compact storage of the cases.

SUMMARY

I address the foregoing problem by means of a caster assembly that is combined with the carrying case but is easily removed therefrom. The caster assembly can be stored inside the case when it is not in use. The caster assembly has a base on which the carrying case rests. The base is supported in turn by a wheeled caster at one end and a strut at the other end. A keel on the underside of the base is disposed between the caster and the strut. The assembly is placed on the case by guiding the strut through the handle until the keel engages snugly with the crossbar of the handle. At this point, the upper surface of the base will bear against the case. The assembly's position on the case is then adjusted until a corner of the case fits with a complementary corner formed by the base and an upright flange at the one end of the base.

DETAILED DESCRIPTION

Figure 1:
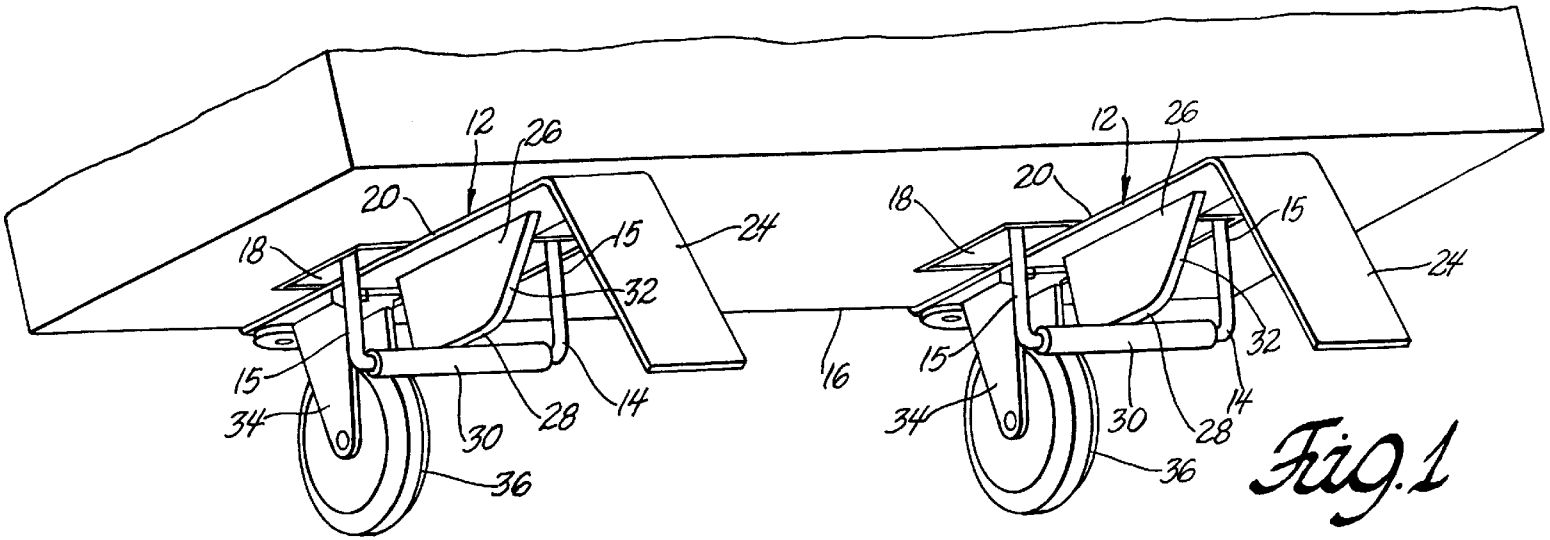
FIG. 1 is a perspective view of a pair of the caster assemblies engaged with handles on the underside of a carrying case.
Figure 2:
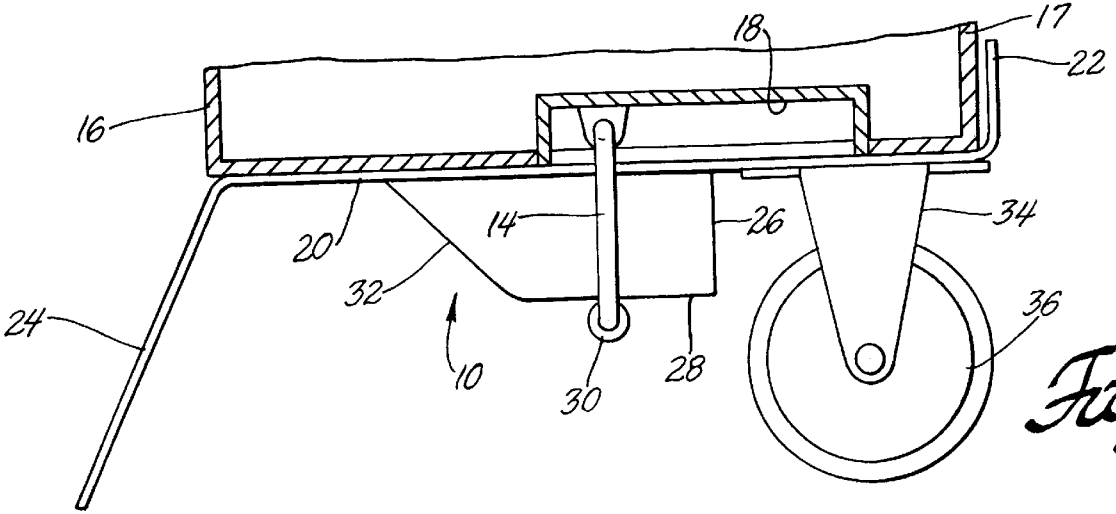
FIG. 2 is a partly sectioned side view of the carrying case resting upon the caster assembly.

FIGS. 1 and 2 show a travel case caster system 10 having caster assemblies 12 engaging handles 14, which are swingably connected to travel case 16 by any suitable means in wells 18. Case 16 may be a suitcase, a footlocker, a container for trade show displays or other type of carrying case. Handles 14 need not be within wells during their folded or retracted position.

Each caster assembly includes a flat base 20 having an upright flange 22 at one end adjacent one side 17 of case 16. At the other end of the base and defining an obtuse angle therewith is a strut 24. Typically, the plate, flange and strut are formed from a single strip of metal. Affixed to the underside of base 20 is a spacer keel 26, which is a plate oriented normal to the base and disposed between legs 15 of handle 14. Keel 26 has a straight outer edge 28 parallel with base 20. Edge 28 fits closely fits against crossbar 30 of handle 14 when the handle is swung out to its FIG. 2 position, normal to plate 20. Adjacent edge 28 is a tapering keel region 32 that is faced toward strut 24 and is spaced apart therefrom.

Keel 26 is disposed between strut 24 and a caster 34 affixed to the underside of base 20 by any suitable conventional means. It is preferred that the caster be positioned as close as possible to the end of base 20 where flange 22 is disposed. Caster 34 includes a wheel 36. It is preferred that the caster and wheel extend downward vertically to the same extent as strut 24, whereby travel case 16 does not tilt when the strut and wheel rest on a horizontal surface.

Handle 14, when not engaged with caster assembly 12, will be within well 18. When it is desired to place assembly 12 on case 16, the handle is swung out and strut 24 is inserted through the handle. As assembly 12 continues through the handle, tapered region 32 engages crossbar 30 and then edge 28 slides on the crossbar until flange 22 is adjacent case 16. At this point case 16 and caster assembly 12 will have the juxtaposition shown in FIG. 2. The distance between the base and edge 28 is such that the crossbar fits closely or snugly against the edge.

Figure 3:
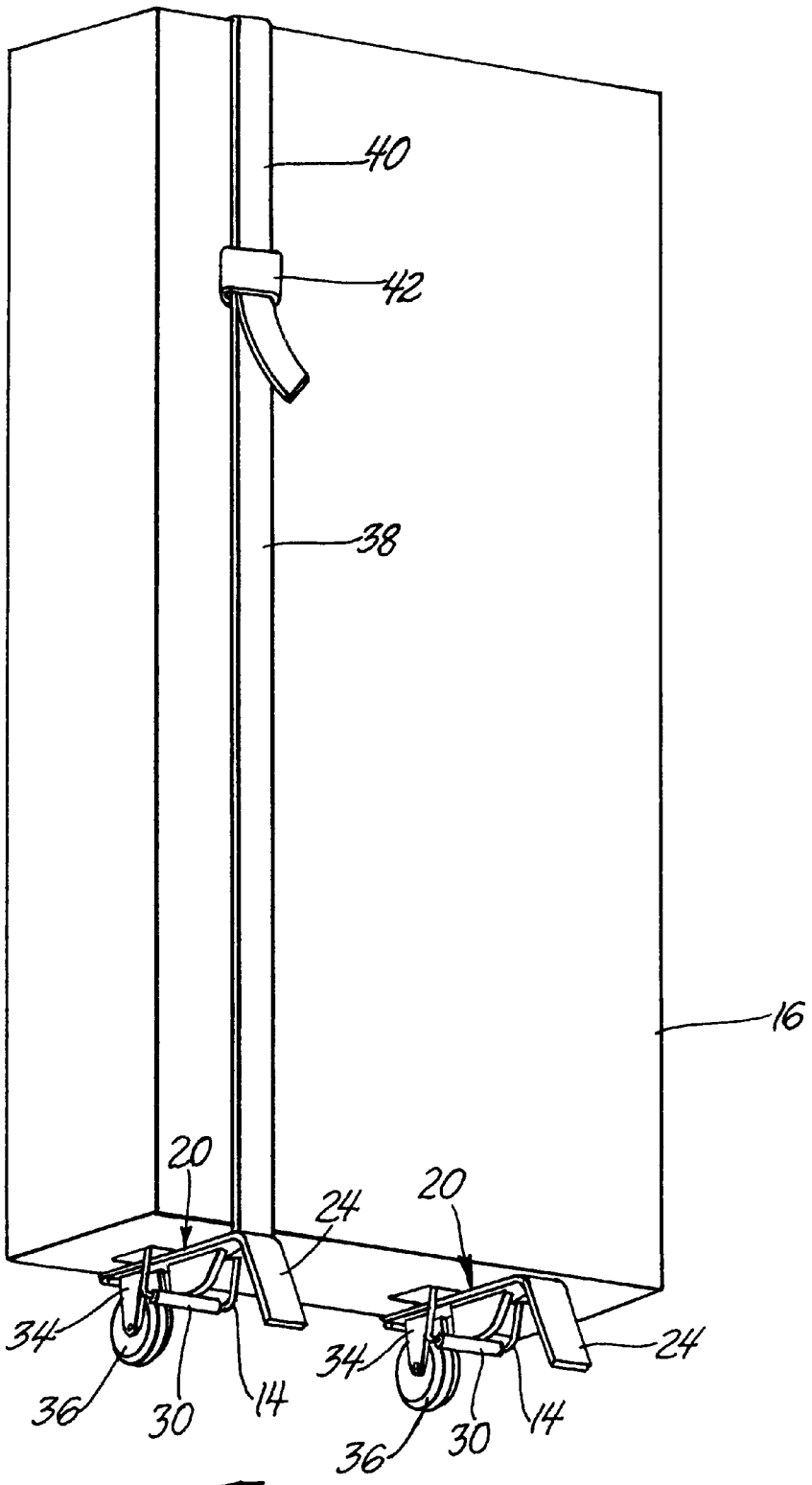
FIG. 3 is a perspective view showing the carrying case on two caster assemblies and straps around the case that are connected to one of the caster assemblies.

FIG. 3 shows an optional added feature of my caster system, wherein flexible belts or straps 38 and 40 are attached to the caster assembly 12. The straps can be tightened about case 16 by means of a buckle or cinch 42.

I do not desire to be limited to the exact details of construction or method shown herein since obvious modifications will occur to those skilled in the relevant arts without departing from the spirit and scope of the following claims.

What is claimed is:

1. A combination of a carrying case and a caster assembly, comprising:

a carrying case;

a handle connected to the case;

a caster assembly engaging the case and the handle;

a base of the assembly, the base having one end and another end, the base facially contacting the case;

a strut of the assembly extending from the one end of the base;

a flange at the other end of the base disposed adjacent a side of the case;

a caster affixed to the base at the other end;

a keel fixed to the base and disposed between the caster and the strut; and an edge of the keel remote from the base engaging the handle.

2. A combination of a carrying case and a caster assembly, comprising:

a carrying case;

a handle swingably connected to the case;

a crossbar of the handle;

a caster assembly engaging the case and the handle;

a base of the assembly having one end and another end, the base facially contacting the case;

a strut of the assembly extending obliquely downwardly from the one end of the base;

an upright flange at the other end of the base disposed adjacent a side of the case;

a caster affixed to the base at the other end;

a keel fixed to the base and disposed between the caster and the strut;

a tapered region of the keel tapering toward the one end of the base; and an edge of the keel adjacent the tapered region and engaging the crossbar of the handle.

* * * * *